US010480151B1

(12) United States Patent
Crites

(10) Patent No.: US 10,480,151 B1
(45) Date of Patent: Nov. 19, 2019

(54) MANHOLE REMOVAL DEVICE FOR USE WITH A MANHOLE CUTTING AND REMOVING TOOL

(71) Applicant: Michael K. Crites, Lima, OH (US)

(72) Inventor: Michael K. Crites, Lima, OH (US)

( * ) Notice: Subject to any disclaimer, the term of this patent is extended or adjusted under 35 U.S.C. 154(b) by 41 days.

(21) Appl. No.: 15/964,758

(22) Filed: Apr. 27, 2018

(51) Int. Cl.
*E02D 29/14* (2006.01)

(52) U.S. Cl.
CPC ..... *E02D 29/1445* (2013.01)

(58) Field of Classification Search
CPC . E02D 29/14; E02D 29/1418; E02D 29/1427; E02D 29/1409; E02D 29/1463; E02D 29/1445; E02D 29/12; E05Y 2900/612; E03F 2005/0413; E03F 5/02; E03F 5/06
See application file for complete search history.

(56) References Cited

U.S. PATENT DOCUMENTS 3,847,339 A * 11/1974 Farrell ..... E02D 29/12 249/1
4,774,386 A * 9/1988 Goodwin ..... B25B 11/00 180/298
4,924,951 A 5/1990 Paulson
5,058,854 A * 10/1991 Bravo ..... B28B 23/0056 249/2
5,306,062 A * 4/1994 Dodge ..... B66C 1/62 294/67.33
5,476,300 A * 12/1995 Dodge ..... B66C 1/54 294/67.33
5,522,646 A 6/1996 Friedman et al.
5,660,422 A * 8/1997 Knisley ..... B66C 1/54 294/67.33
6,536,987 B2 3/2003 Chang
7,703,856 B1 * 4/2010 Duncan ..... B66F 19/005 299/39.3
8,011,851 B1 9/2011 Crites
9,127,430 B2 * 9/2015 Mitchell ..... E02D 29/1445
9,290,370 B1 * 3/2016 Panio ..... B66C 1/28
2011/0084540 A1 * 4/2011 Cochran ..... E01C 23/094 299/18
2012/0061632 A1 * 3/2012 Panio ..... B66C 1/28 254/133 R

* cited by examiner

*Primary Examiner* — Abigail A Risic
(74) *Attorney, Agent, or Firm* — Harpman & Harpman

(57) ABSTRACT

An improved manhole alignment and locking assembly for use with a manhole removal tool. The locking and removal assembly provides for a portable adjustable manhole interior engagement plate, that once positioned and locked, provides for alignment of the manhole cutting and removal tool and subsequent lifting and transportation of the manhole from the street for repair or replacement.

8 Claims, 8 Drawing Sheets

MANHOLE REMOVAL DEVICE FOR USE WITH A MANHOLE CUTTING AND REMOVING TOOL

BACKGROUND OF THE INVENTION

1. Technical Field

This device relates to automatic digging and cutting machines that have been developed to cut and remove manholes from streets for repair and replacement, due to changes in street elevation by resurfacing, repair or replacement.

2. Description of Prior Art

Prior art devices of this type can be seen in U.S. Pat. Nos. 4,924,951, 5,522,646, 6,536,987 and applicant's own U.S. Pat. No. 8,011,851.

U.S. Pat. No. 4,924,951 claims a manhole cutter for cutting a fixed diameter circular groove of fixed depth around the surface of the manhole. The cutter is of a continuous ring design with spaced sections having cutting teeth elements.

U.S. Pat. No. 5,522,646 discloses an apparatus for cutting free a manhole casing having a support plate positioned on a cover with a bracket and rotating cutting assembly.

U.S. Pat. No. 6,536,987 claims a quick manhole construction method having an interior member engagement cover lifter with multiple threaded arms, deployable against the interior surface of a manhole for engagement.

Finally, in U.S. Pat. No. 8,011,851 a locking and alignment assembly for a manhole having a pair of oppositely disposed expanding arcuate engagement bands assemblies and multiple engagement plates, positioned thereabout for engagement and lifting of a manhole once cut free of the surface.

SUMMARY OF THE INVENTION

An improved manhole alignment, locking and removing assembly tool for use with a mobile manhole cutting tool for removing a manhole from a street surface for repositioning and/or replacement. The manhole removal tool is self-centering, adjusting to different manhole dimensions, and locked in place for a cutting tool guide centering and functioning as a manhole lifting device once cut free of the street by engaging a pair of adjustable lift flanged lifting posts against the interior of the manhole frame.

DETAILED DESCRIPTION OF THE INVENTION

Figure 4:
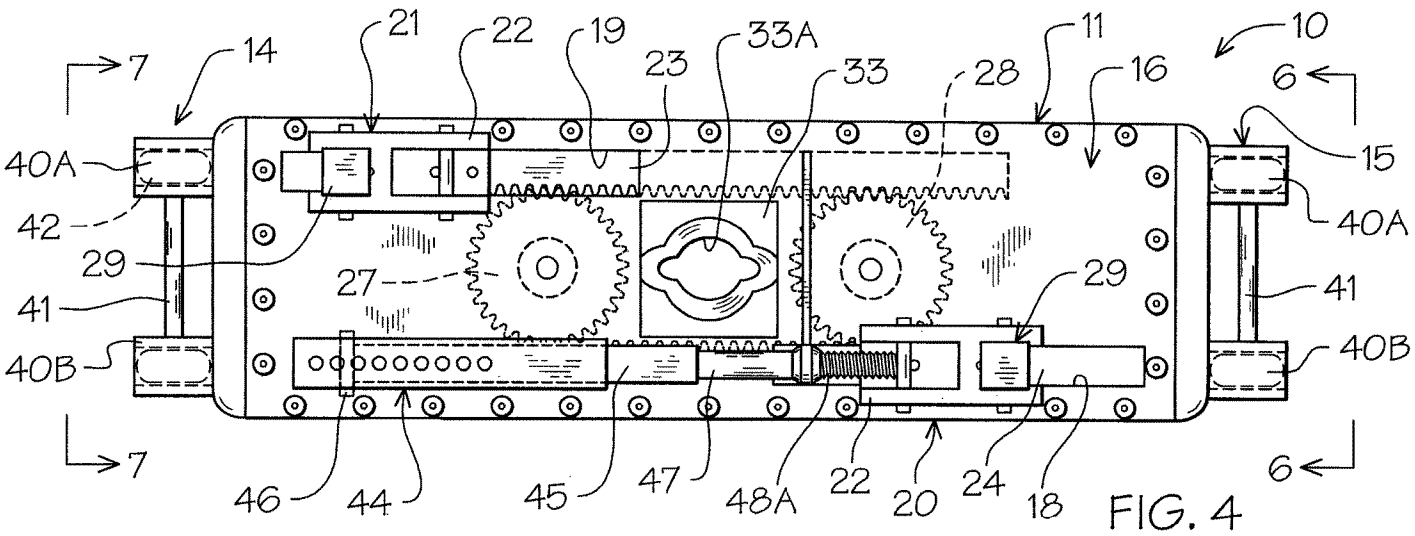
FIG. 4 is a top plan view of the manhole alignment locking and removing device of the invention.

Referring to FIGS. 1-4 and 8 of the drawings, an improved manhole alignment locking and removal assembly tool 10 of the invention can be seen, having a rectangular housing 11 with space parallel sides 12, 13 and oppositely disposed wheel support end assemblies 14, 15. The housing 11 has a top surface 16 and bottom surface 17 with pairs of aligned rectangular slots 18, 19 extending therethrough respectively, as best seen in FIGS. 4 and 5 of the drawings.

Figure 1:
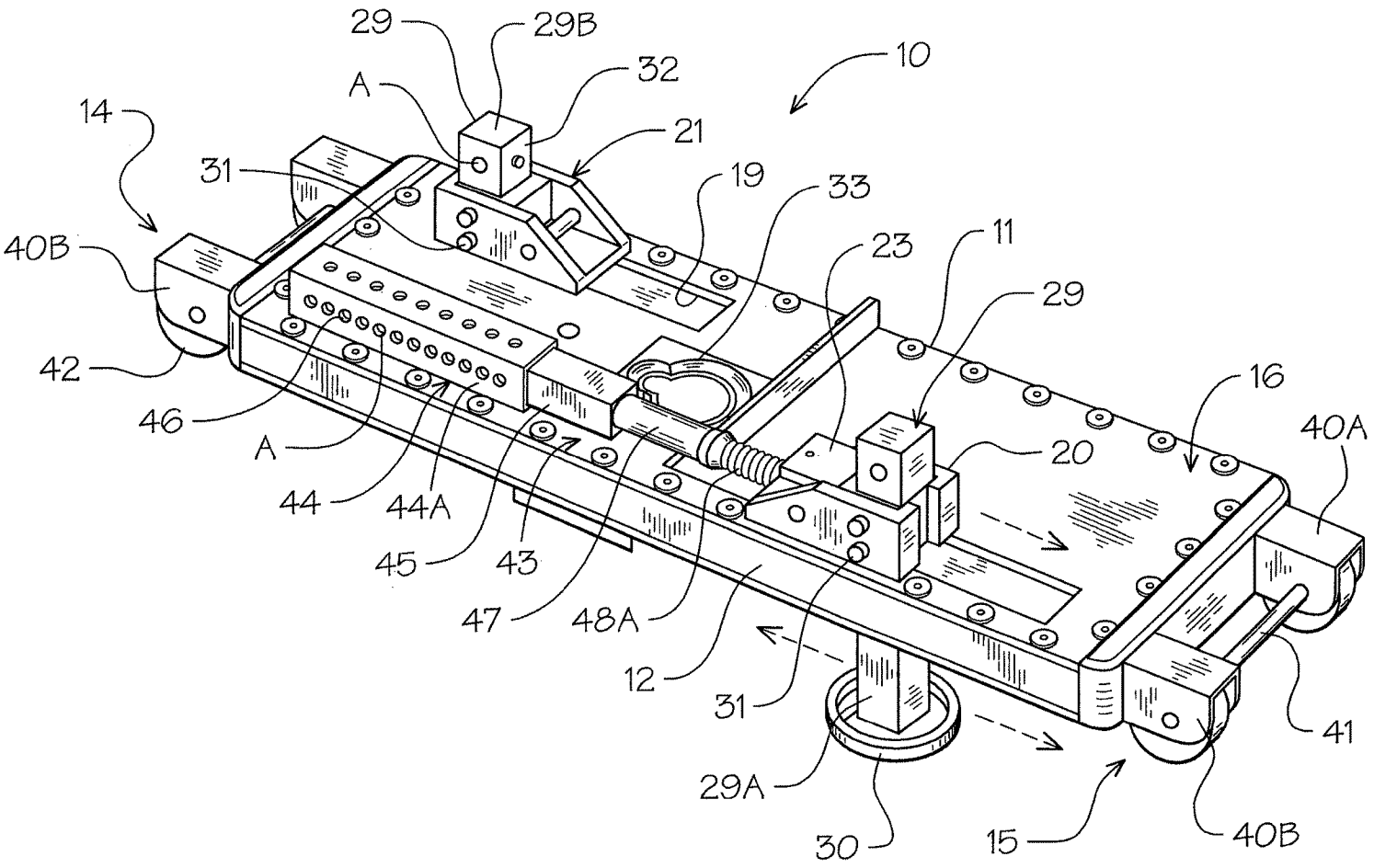
FIG. 1 is a perspective view of the manhole alignment locking and removing device of the invention.
Figure 2:
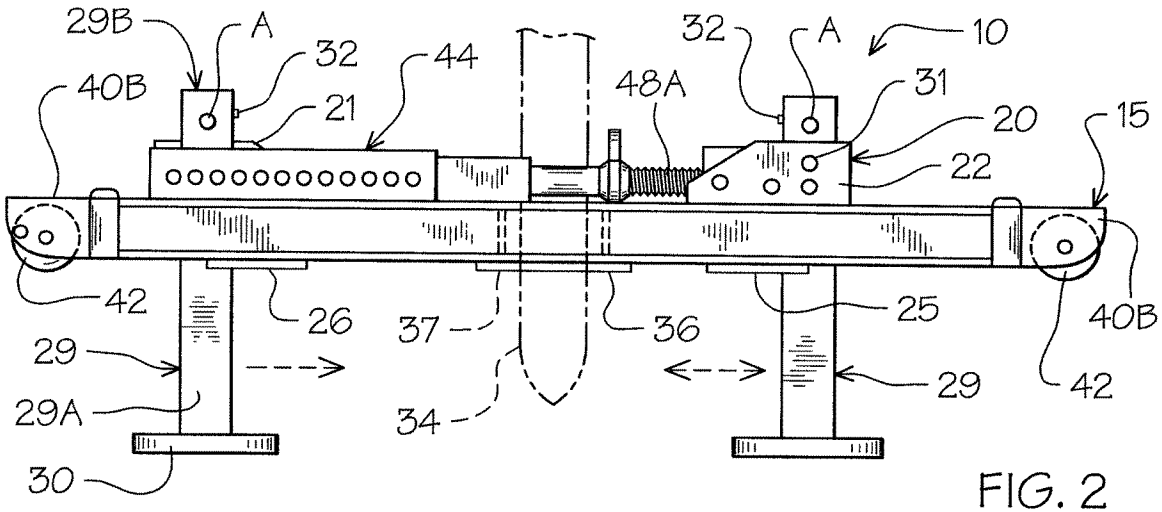
FIG. 2 is a front elevational view thereof.
Figure 3:
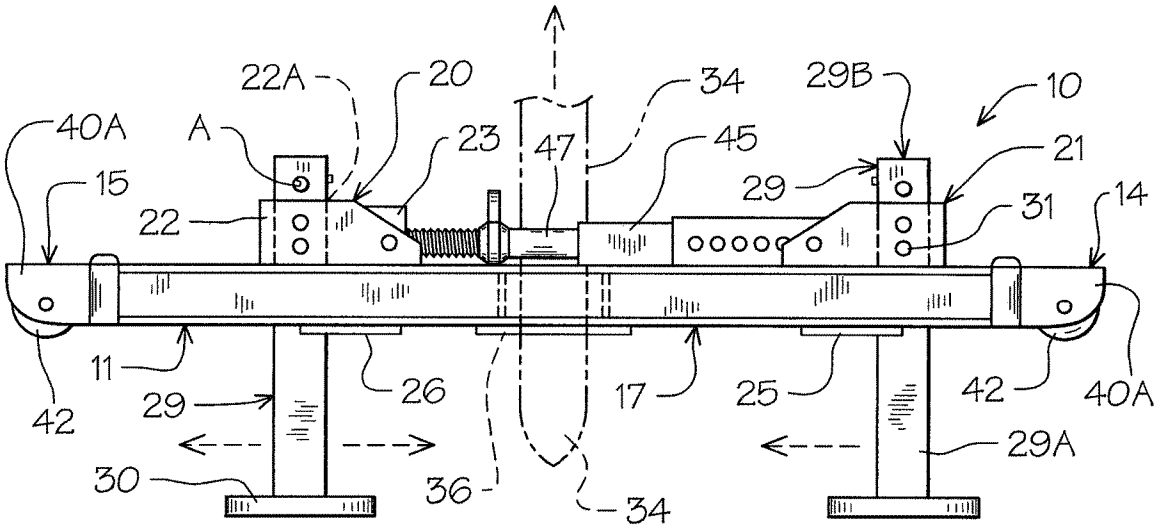
FIG. 3 is a rear elevational view thereof.

A pair of movable leg engagement supports 20, 21 are slidably disposed within the respective slots 18, 19 best seen in FIGS. 1 and 4 of the drawings. Each of the leg engagement supports 20, 21 have an H-shaped frame 22 with a vertical leg receiving area at 22A. A tensioning adjustment assembly (described in greater detail hereinafter) extends from a support block 23 in the leg mount 20 in space relation to the leg receiving area 22A. The leg engagement supports 20, 21 are slidably retained within the respective slots 18, 19, being secured to respective gear racks 23, 24 aligned within the slot openings and extending beyond within the housing 11 interior between the corresponding housing top and bottom surfaces 16,17, as seen in FIG. 8 of the drawings.

Figure 5:
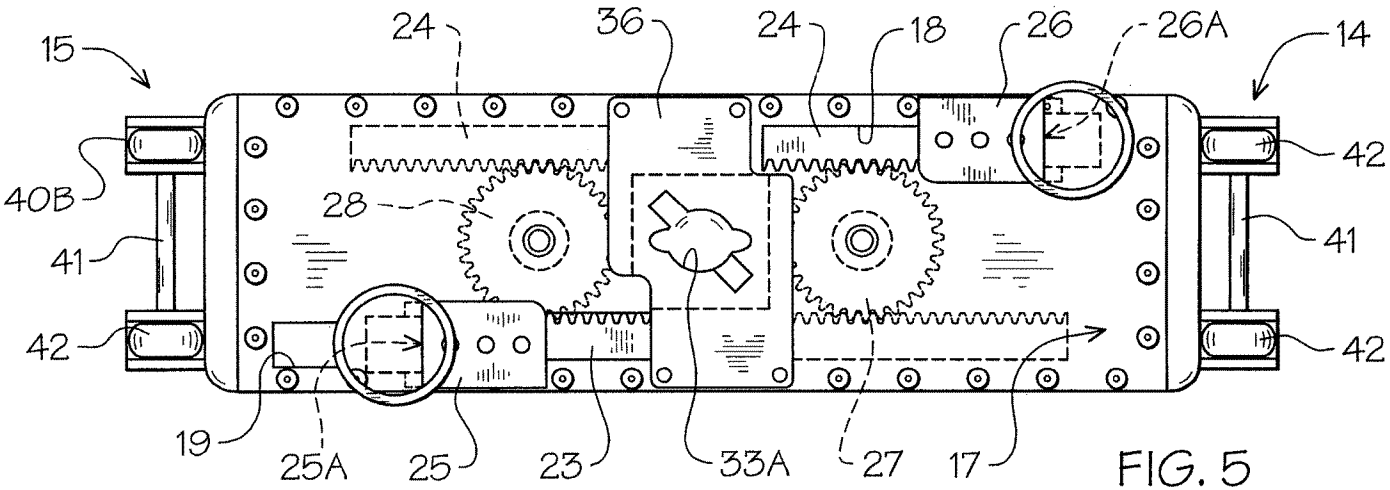
FIG. 5 is a bottom plan view thereof.
Figure 6:
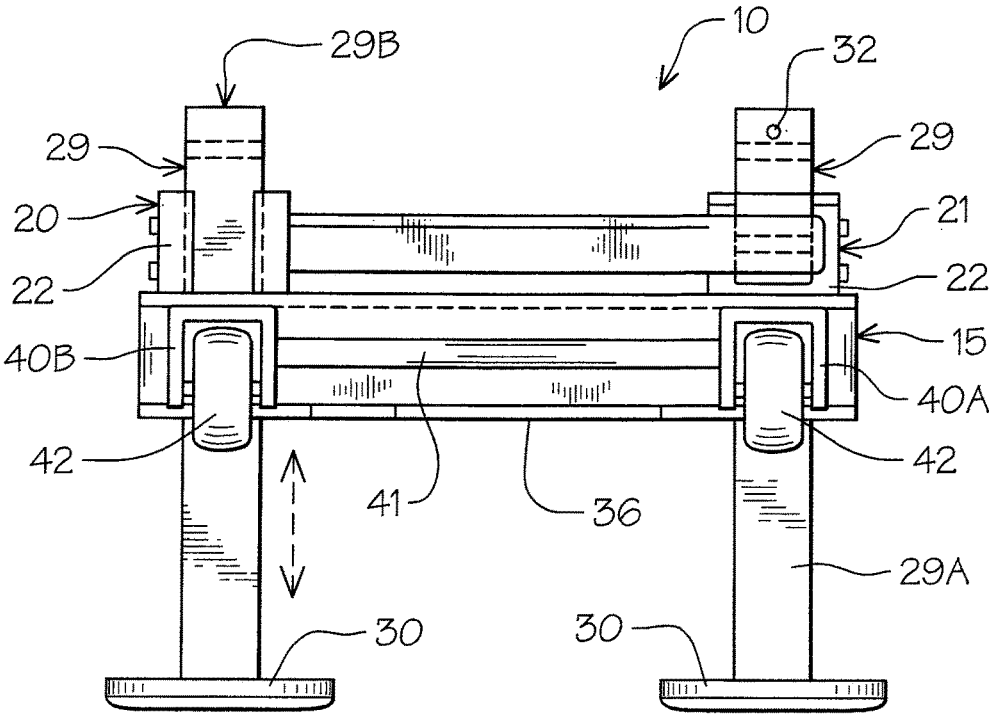
FIG. 6 is an end elevational view on line 6-6 of FIG. 4.
Figure 7:
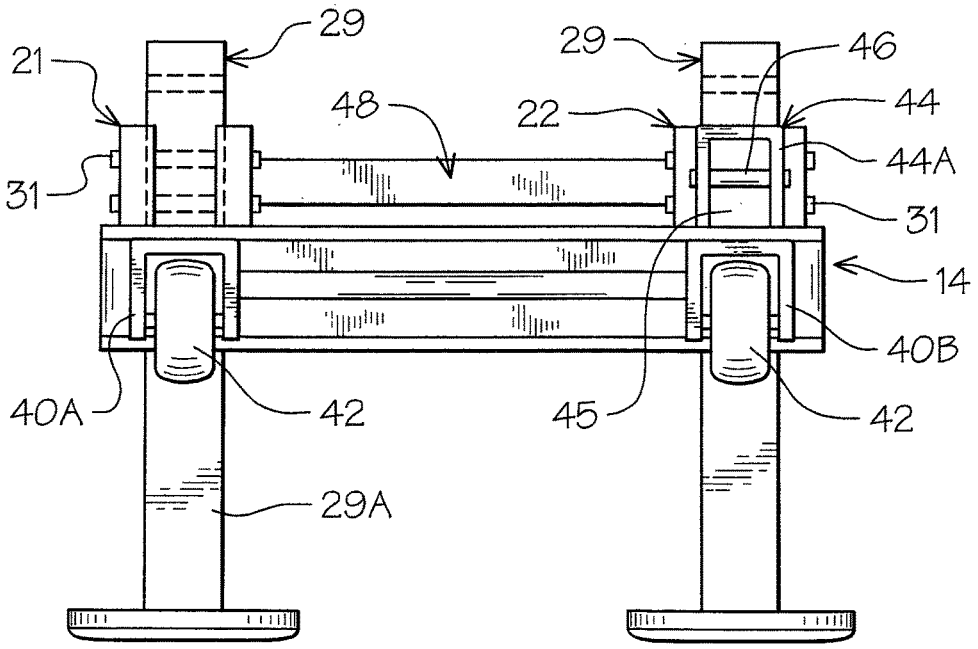
FIG. 7 is an end elevational view on 7-7 of FIG. 4.

A pair of apertured retainment plates 25, 26 are secured respectively to the gear racks 23, 24, best seen in FIG. 5 of the drawing, retaining the respective gear racks 23, 24 and their attached movable leg engagement supports 20, 21 there within. The retainment plates 25, 26 are slidably disposed over the bottom surface 17, adjacent to slot openings each with a leg receiving notch 25A, 26B therein.

Figure 8:
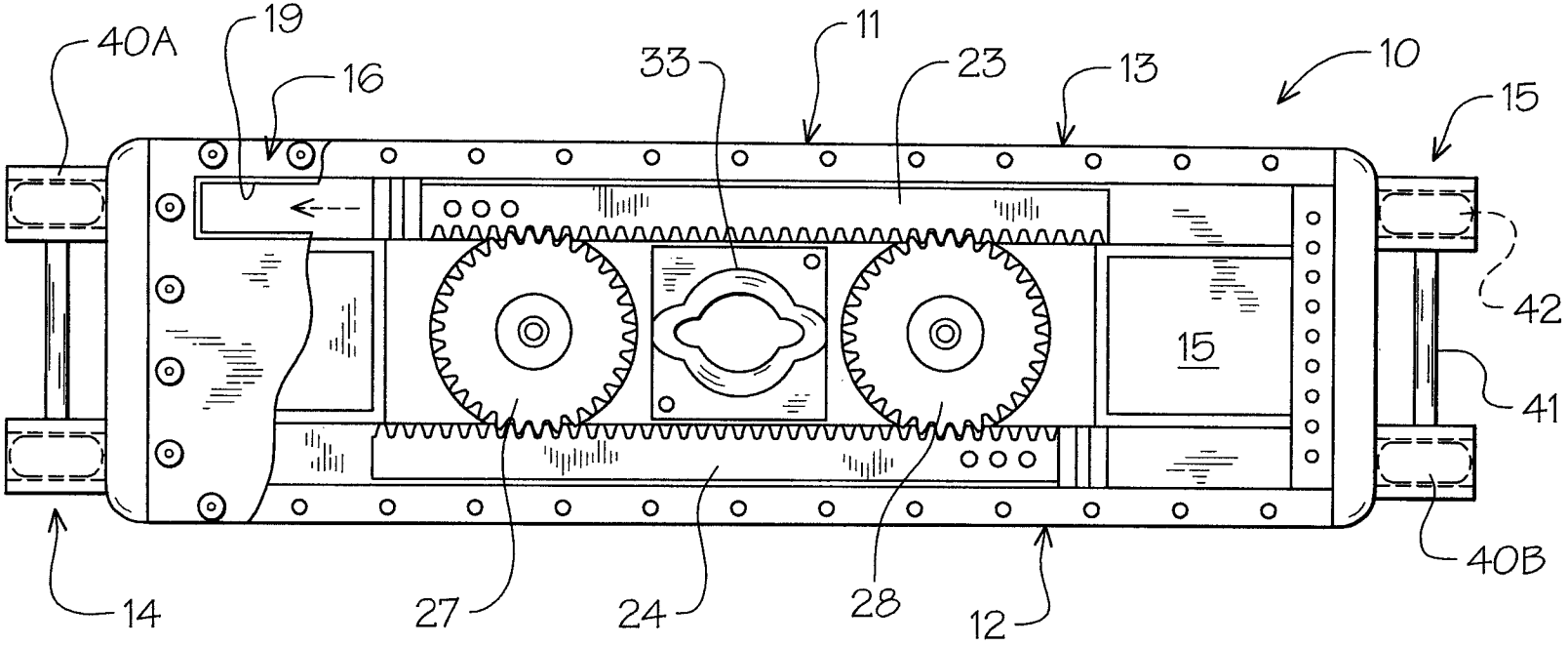
FIG. 8 is a top plan view with portions broken away for illustration.

A pair of longitudinally spaced pinion engagement gears 27, 28 are rotatably mounted within the main housing 11, for registration with the spaced gear racks 23, 24, illustrated in broken lines in FIG. 4 and in solid lines in FIG. 8 of the drawings. It will be evident from the above description that by interlinking the respective gear racks 23, 24 that the corresponding attached slidable leg engagement supports 20, 21 will move simultaneously in oppositely disposed directions within their respective guide slots 18, 19.

Independent manhole engagement and lifting legs 29, best seen in FIGS. 1-3 and 6-7 of the drawings are adjustably secured within the respective leg openings 22A in the leg engagement and supports 20, 21.

Figure 10:
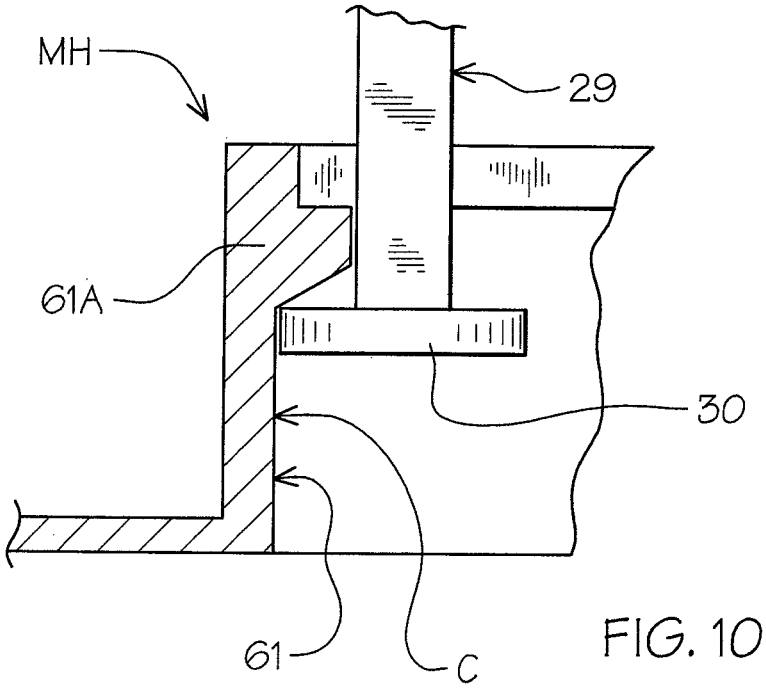
FIG. 10 is an enlarged partial cross-sectional view of a manhole frame engaged by the manhole alignment locking and removing device.

Each of the legs 29 has an elongated shaft 29A with an end mounted engagement disk 30 thereon. Engagement disk 30 in this example has an arcuate opening 30A therein, as best seen in FIGS. 5 and 10 of the drawings.

The shaft 29A has multiple longitudinally spaced apertures A therethrough which are spaced inwardly of its respective free ends 29B for receiving a locking pins 31 that will extend through corresponding spaced aligned apertures A formed within respective sides of the leg supports 20, 21 thereby adjustably positioning and securing the lift legs 29 for vertical adjustment within the respective movable leg engagement supports 20, 21. A spring-loaded detent ball fitting 32 in each of the lift legs 29 is providing so as to retain the leg displacement within the supports before the locking pins 31 can be inserted, as is well-known and understood within the art.

Figure 9:
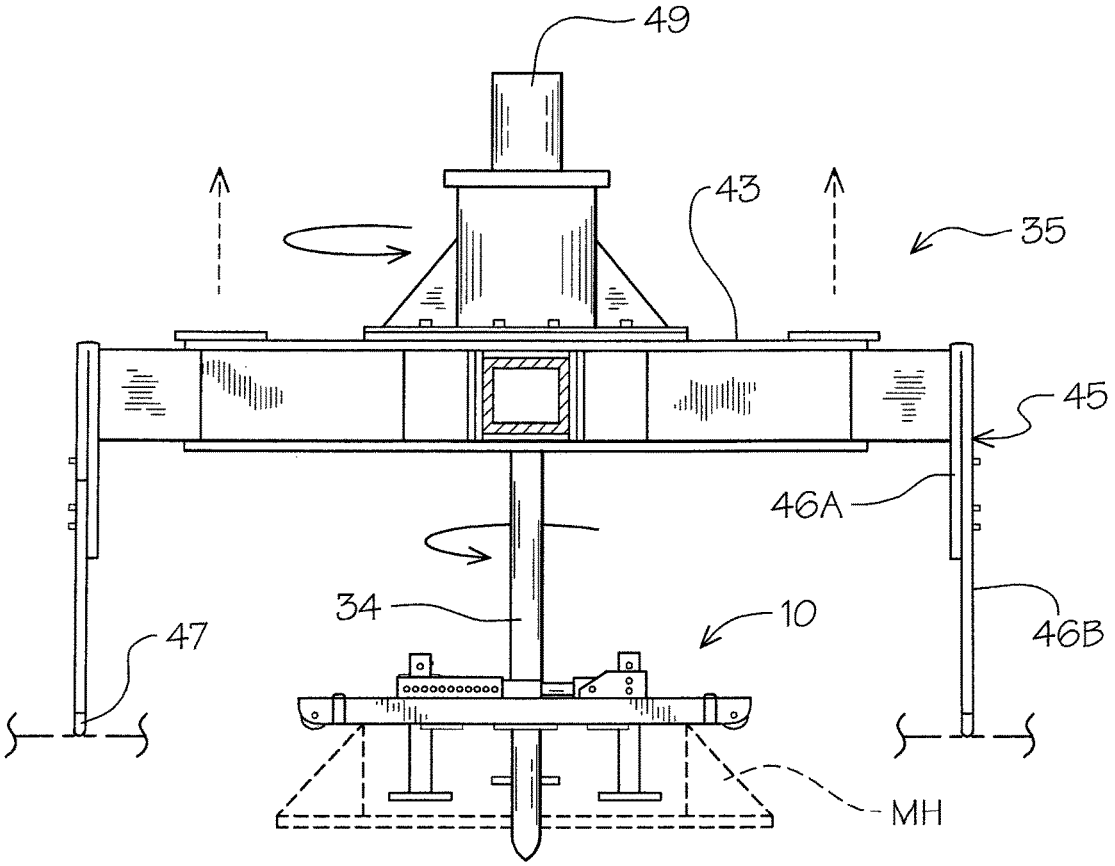
FIG. 9 is a side elevational view of the manhole alignment locking and removing device of the invention engaged by a manhole cutting assembly tool.

Referring now to FIGS. 4, 8 and 9 of the drawings, a reinforced key-way fitting block 33 is positioned within the housing 11 between the respective rack and pinion gears 27, 28, providing an alignment and access key-way opening 33A therethrough for a drive and lift shaft 34 of a manhole cutting assembly 35. An aperture reinforcement plate 36 is secured to the housing 11 bottom surface 17 having a corresponding offset key-tab receiving recess 36A for registration of a pair of oppositely disposed lifting tabs 37 extending to extend from the drive and lifting shaft 34 for lifting same during drive shaft reorientation and retraction, as will be described.

The oppositely disposed end wheel assemblies 14, 15 are secured to the respective ends of the housing 11, each having a pair of bifurcated wheel mounts 40A, 40B respectively, each with corresponding wheels 42 therein.

A lift handle rod 41 extends between the respective wheel mounts 40A, 40B, providing a manual grip engagement for lifting and pulling the manhole alignment locking and removal assembly 10 on its respective oppositely disposed engaged wheels 42, when required to reposition and move independently for engagement.

Referring back to FIGS. 1 and 4 of the drawings, a leg adjustment and tensioning assembly 43 can be seen on the housing 11, having a fixed inverted U-shaped aperture channel 44 with a slidably disposed length adjustment bar 45 there within. A registration end stop-pin 46 is provided for selectively positioning through appropriate aligned apertures A in the channel 44 oppositely disposed sides 44A depending on the initial adjustment and alignment of the movable leg engagement supports 20, 21 during the initial positioning of the tool within the manhole MH.

An adjustment rod 47 extends from the adjustment bar 45 and has an adjustment handle nut assembly 48 on a threaded shaft 48A, which extends from the hereinbefore described support block 23 in the movable leg engagement support fitting 20 which is slidably disposed within its corresponding slot 19 as noted.

Referring to FIG. 9 of the drawings, the manhole cutting assembly 35 is disclosed in the inventor's U.S. Pat. No. 8,011,851 which is included by reference herewith.

The manhole cutting assembly 35 has a support frame 49 with multiple extensible cutting blade mounting arms 49A4 extending radially therefrom. Each of the arms 49A has an independent cutting blade assembly 50 depending therefrom, having adjustable overlapping blades support elements 51A, 51B with a hardened cutting teeth assembly 52 on thick respective free ends.

The drive and lift shaft 34 extends through the center of the support frame 48 with an upstanding reinforced tool attachment fitting 53 having a drive attachment 54, providing the cutting assembly 35 axial rotation when engaged by a portable rotary equipment drive (not shown), as it will be well-known in the industry.

Figure 11:
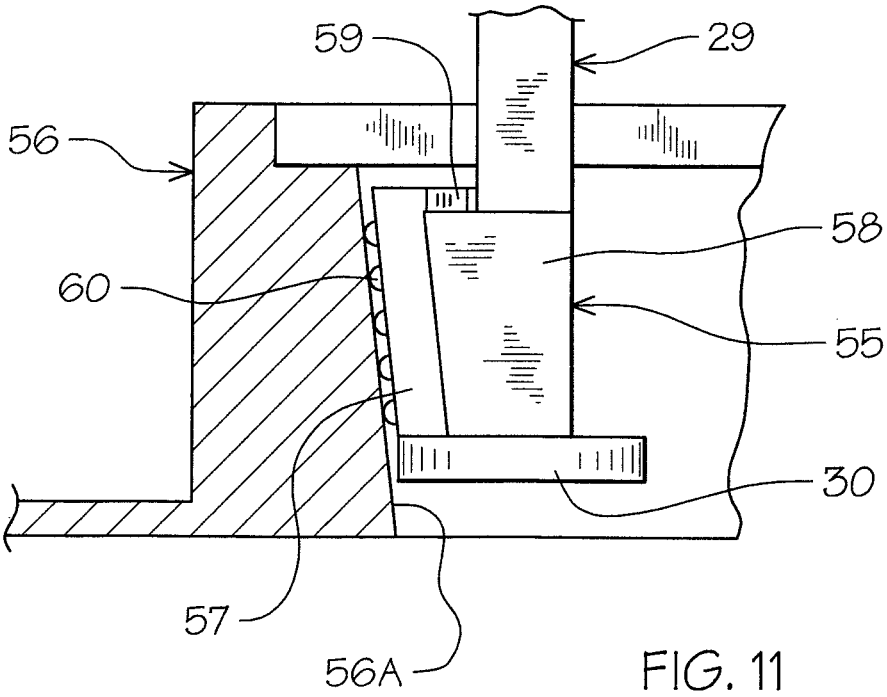
FIG. 11 is an enlarged partial cross-section view of an alternative manhole for interior surface engagement with alternate lifting tool leg attachment configurations.
Figure 12:
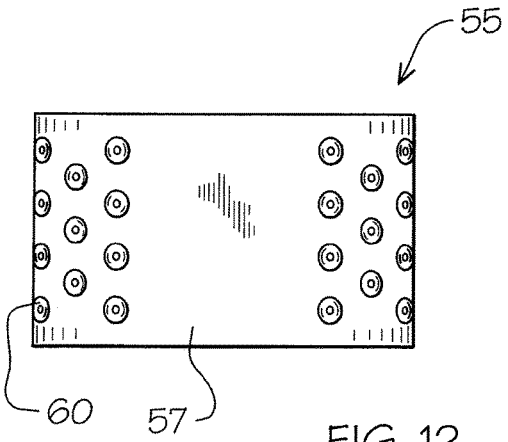
FIG. 12 is a front elevational view of the alternative lifting leg attachment.
Figure 13:
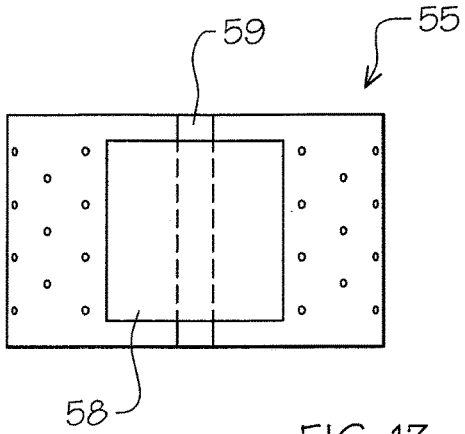
FIG. 13 is a rear elevational view thereof.
Figure 14:
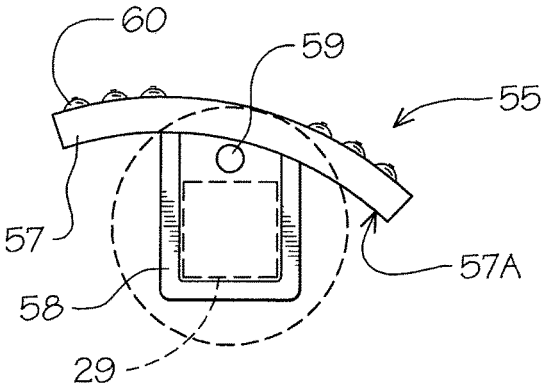
FIG. 14 is a top plan view thereof, mounted on a lifting leg.
Figure 15:
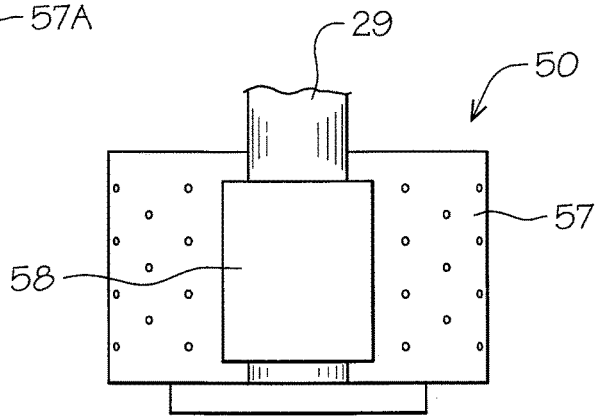
FIG. 15 is a rear elevational view thereof.

Referring now to FIGS. 12-15 of the drawings, an alternate lifting leg attachment 55 can be seen to provide an adaptive leg engagement surface for use on alternative manhole frame configurations 56, as seen in FIG. 11 of the drawings, which have a smooth tapered interior annular surface 56A.

The leg attachment 55 has a curved rectangular plate 57 with leg shaft engagement bracket 58, extending from its inside surface 57A. It will be seen that the bracket 58 is U-shaped, providing a leg registration opening therewithin. A spacer engagement rod 59 in this example, is welded to the inside side surface 57A within the attachment bracket 58. A plurality of manhole surface engagement nodules 60 are secured on an outer curved contacting engagement surface 57B of the plate 57 for contact with the smooth interior surface 56A of the alternate manhole frame configuration 56. It will be evident from the above description that with the use of the contoured leg attachments 55 on each of the respective engagement and support legs 29 will provide adaptive registration to alternative manhole configurations.

In use, the alignment locking and removal assembly tool 10 of the invention is positioned within an open manhole MH, illustrated in FIGS. 9, 10 of the drawings, with the movable leg engagement supports 20, 21 adjusted to provide direct contact of the lift legs 29 against the interior of the manhole 61, as illustrated in FIG. 10 of the drawings and under the cover lip 61A. The leg engagement supports 20, 21 are then locked and tensioned in place by initial repositioning of the end stop pin 46 and the tensioning and lock assembly 43 by use of the adjustment handle nut assembly 46 provided for final incremental advancement and tensioning movement thereof, as herein before described.

Once so positioned and locked in place, the engagement lift legs 29 will provide a secure point of oppositely disposed contact C with the manhole for removable once the surrounding pavement material has been continuously cut.

The manhole cutting assembly tool 35 is then positioned over the manhole MH and lowered with the drive shaft 34 extending through the key-shaped opening 33A in the housing 11, as seen in FIG. 9 of the drawings, with the shaft's 34 lifting tabs 37 extending beyond the removable assembly 10.

The manhole cutting assembly 35 is then rotated by the power equipment power take-off (not shown) rotating the cutting assembly and cutting into the street surface SF defining a continuous cut of a greater diameter than that of the manhole MH. Once cutting is complete, the drive shaft 34 is retracted and thereby engages its lifting tabs 37 within the key receiving offset recess 36A lifting the manhole MH and surrounding street surfaces therefrom.

It will be evident from the above description that the improved manhole alignment locking and movable assembly tool 10 will provide centering guidance and that the utilization of the alternate lifting leg attachments 55 which are placed on the respective lifting legs 29, as hereinbefore described, allow for smooth surface wedging engagement of alternate manhole interior configurations 56, as seen in FIG. 11 of the drawings, thus locking the removal tool assembly 10 of the invention in place as previously described and allowing for removal by the cutting tool 35 drive shaft 34 as noted.

It will thus be seen that a new and novel manhole alignment locking and removable assembly 10 of the invention has been illustrated and described and it will be apparent to those skilled in the art that various changes and modifications may be made thereto without departing from the spirit of the invention.

Therefore, I claim:

1. A manhole alignment, locking and removal tool assembly for selective and independent engagement within a manhole comprises, a main support housing, a pair of offset parallel guide and retainment slots in said housing, a pair of leg engagement supports slidably positioned within said guide and retainment slots, engagement and lifting legs adjustably disposed within and extending from said leg engagement supports through said support housing, a dual rack and pinion gear assembly within said slots and said housing, said leg engagement supports secured to said racks, a guide and extraction key-way in said housing for receiving an extraction drive shaft, key-way engagement tabs extending from said extraction drive shaft for selective engagement therewith and removal thereof, means for moving said tool assembly independently of said extraction drive shaft.

2. The manhole alignment, locking and removal tool assembly of claim 1, wherein an adjustable tensioning and locking assembly extends from one of said leg engagements supports, said adjustable tensioning and locking assembly comprises, an indexed telescopically disposed adjustment bar, a threaded adjustment rod extending therefrom in communication with one of said leg engagement supports for actual rotation therewithin.

3. The manhole alignment, locking and removal tool assembly of claim 1, wherein said engagement lifting legs comprises, an aperture shaft adjustably retained within said leg engagement support, a manhole engagement disk on the end of said shaft for direct engagement with said manhole.

4. The manhole alignment, locking and removal tool assembly set forth in claim 1, wherein said guide and extraction key-way in said housing comprises, a reinforced key-way fitting between said dual rack and pinion gears, and an apertured reinforcement wear plate having oppositely disposed drive shaft lifting tab receiving recesses therewithin aligned on said key-way.

5. The manhole alignment, locking and removal tool assembly set forth in claim 1, wherein said leg engagement supports comprises, a lifting leg receiving opening, multiple leg engagement and retainment pins extending through aligned apertures within said engagement support and said lifting leg.

6. The manhole alignment, locking and removal tool assembly set forth in claim 1, wherein said means for moving said tool assembly independently of said extraction drive shaft comprises, a pair of oppositely disposed wheel and handle assemblies, each having a pair of spaced wheels and a handle rod extending between said spaced wheels in relation to said housing end.

7. The manhole alignment, locking and removal tool assembly of claim 2, wherein said rack and pinion gear assemblies comprises, a pair of spaced parallel gear racks and a pair of spaced inter-engaging pinion gears therebetween.

8. The manhole alignment, locking and removal tool assembly set forth in claim 1 further comprises, removable alternate manhole engagement fittings for said engagement lifting legs, said alternate engagement fittings having a contoured surface engagement plate, a lift leg attachment bracket on said surface engagement plate, and a plurality of spaced nodules on said surface engagement plate in oppositely disposed relation thereto.

* * * * *